US006100479A

United States Patent [19]

Fust et al.

[11] Patent Number: 6,100,479

[45] Date of Patent: Aug. 8, 2000

[54] ACTUATOR FOR A SAFETY SWITCH

[75] Inventors: Guntram Fust, Hattingen; Klaus Schulze, Radevormwald, both of Germany

[73] Assignee: K.A. Schmersal GmbH & Co., Germany

[21] Appl. No.: 09/265,767

[22] Filed: Mar. 10, 1999

[30] Foreign Application Priority Data

Mar. 12, 1998 [DE] Germany ..... 198 10 735

[51] Int. Cl.[7] ..... H01H 3/00

[52] U.S. Cl. ..... 200/329; 200/4

[58] Field of Search ..... 200/4, 547, 17, 200/564

[56] References Cited

U.S. PATENT DOCUMENTS 5,595,286 1/1997 Schulze ..... 200/335

FOREIGN PATENT DOCUMENTS 3100862 1/1981 Germany .
3209414 9/1983 Germany .
3330109 3/1985 Germany .
3433048 3/1986 Germany .
4436199 10/1994 Germany .
29510071 6/1995 Germany .
29516230 10/1995 Germany .
4432862 10/1995 Germany .
29701797 2/1997 Germany .

OTHER PUBLICATIONS

European Search Report dated Jul. 14, 1999.

*Primary Examiner*—Michael L. Gellner
*Assistant Examiner*—Nhung Nguyen
*Attorney, Agent, or Firm*—Douglas J. Christensen

[57] ABSTRACT

The invention relates to an actuator for a safety switch provided with at least one insertion slot with inclined insertion guides for the actuator, having a holder which can be fastened to a part whose open and closed positions are to be monitored, and which is fitted with the key mounted on it such that the said key can be moved, the key comprising a foot, and the holder being provided with a recess for the key on the side facing the key and with a bearing for the foot, the said bearing extending around the recess and allowing the foot to be displaced and rotated.

9 Claims, 2 Drawing Sheets

ACTUATOR FOR A SAFETY SWITCH

TECHNICAL FIELD

The invention relates to safety switches as they are used in connection with a corresponding control device for surveying the open and closed position of a door, a cover, a flap or the like of restricted areas containing revolving machines or other dangerous equipment so that the restricted area is only accessible in the case of no danger for operators and the machine or other equipment can only be started when all doors, covers, flaps or the like are closed. More specifically, the invention concerns an actuator for a safety switch.

BACKGROUND OF THE INVENTION

An actuator for a safety switch is disclosed in German Patent 4,432,862, for example. This actuator has a key which is fastened by means of a holder to a cover, door, flap or the like whose open and closed positions are to be monitored, and which can be tilted about an axis of the holder against a spring load from a preset tilting direction, this axis running perpendicular to the pivot axis of the actuator. This arrangement allows not only pivoting about the pivot axis but also tilting relative to the pivot plane. As a result, tolerances arising in various parts during assembly of the safety switch and its actuator can be compensated for, although the design is complex and also does not permit the key to rotate about an axis in the pivot plane, so that corresponding misalignments between the safety switch and the actuator cannot be compensated for, which means that imprecise positioning of the safety switch and/or actuator causes the latter to miss the insertion opening of the safety switch and then not be able to actuate the said safety switch.

SUMMARY OF THE INVENTION

An object of particular embodiments of the invention is to provide an actuator for a safety switch, which is of simple design. A further object of particular embodiments of the invention is to provide an actuator having a key which is rotatable.

Thus, in a preferred embodiment, the invention concerns an actuator for a safety switch provided with at least one insertion slot with inclined insertion guides for the actuator, said actuator comprising a holder which can be fastened to a part whose open and closed positions are to be monitored, and a key held such that it can be moved by the holder and fitted with the holder, wherein the key comprises a foot, and the holder is provided with a recess for the key on the side facing the key and with a bearing for the foot, the said bearing extending around the recess and allowing the foot to be displaced and rotated.

In this arrangement, in the context of the actuator comprising the holder and the key which is held on the latter and provided with the foot, the said key is arranged such that it can be displaced and rotated in any desired direction, by virtue of the fact that either the foot or the holder has two discs which each accommodate a disc of the other part, preferably spring-loaded into a central position, between them and mount it by means of bearings such that it can be displaced and rotated.

Further objects, advantages and embodiments of the invention will become apparent from the following detailed description and accompanying drawings.

DESCRIPTION OF PREFERRED EMBODIMENTS

Figure 1:
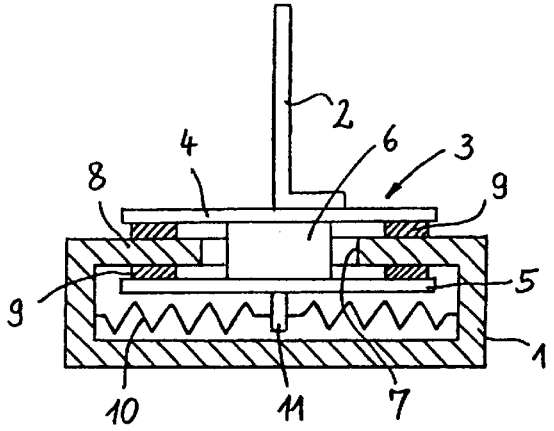
FIG. 1 shows a partial section of an actuator for a safety switch according to the present invention.

The actuator 20 shown in FIGS. 1–2 and 5–6 is used for actuating a safety switch 30 provided with at least one insertion slot 32 with inclined insertion guide bevels 34 and 35 for the actuator. Such safety switches are described in German patents 3,100,862, 3,209,414, 3,330,109 or 3,433,048 (but without inclined insertion guides for the actuator), for example. In the safety switch of FIG. 5, an element 46 is displaced to actuate the safety switch when a key 2 of the actuator 20 is withdrawn.

The actuator comprises a housing-type holder 1 by means of which it is fastened to a part 40 whose open and closed positions are to be monitored, whereas the safety switch is fastened to a stationary part 42, so that the said safety switch is actuated when the moving part 40 to be monitored opens and closes.

The holder 1 is fitted with the key 2 which can be essentially of bow-shaped or double-bow-shaped design, for example. The key 2 is provided with a foot 3 and is screwed to it, for example. The foot 3 is formed from two parallel discs 4, 5 which are spaced apart from one another and are connected to one another by a cylindrical intermediate piece 6, the two discs 4, S extending essentially perpendicular to the plane of the key 2. The two discs 4, 5 enclose a front plate 8 (provided with a recess 7 and essentially parallel to the discs 4, 5) of the holder 1 between them and are mounted such that they can be displaced relative to the said front plate 8.

As shown, the foot 3 is mounted, in particular, by means of circular sliding bearings 9 made from PTFE polytetrafluorethylene), for example, which are fastened on both sides of the front plate 8, such that it can be displaced relative to the holder 1 by sliding, but an appropriate roller bearing may also be provided instead.

In addition, the foot 3 is expediently spring-loaded into a central position relative to the recess 7 by means of spring elements 10. In the exemplary embodiment shown, the spring elements 10 are designed as helical springs, a total of four (but no less than three and, if appropriate, more than four as well) of these being provided engaging symmetrically on a central pin 11 on the foot 3. The spring elements 10, arranged essentially in one plane parallel to the front plate 8, are accommodated inside the holder 1. Thus, the foot 3—and hence the key 2—is arranged such that it can be displaced in any desired direction relative to the plane of the front plate 8, and at the same time is rotatable, so that corresponding misalignments between the safety switch and the actuator can be compensated for, which means that the actuator is guaranteed to find the inclined insertion guides of the safety switch within defined limits and will accordingly be inserted reliably for actuating the safety switch. In this case, the cylindrical intermediate piece 6 and/or the disc 5 serve as a stop to limit the displacement movement.

Figure 3:
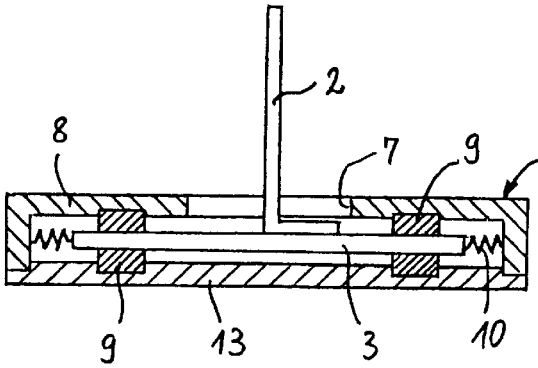
FIGS. 3 and 4 show a section of two further embodiments of an actuator.

Another embodiment 20.1 of the present actuator is shown in FIG. 3. In this embodiment, the foot 3 of the key 2 comprises only one individual disc running approximately perpendicular to the plane of the key 2, whilst, on the inner sides of the front plate 8 and of a back wall 13 of the holder 1, the sliding bearings 9 (or roller bearings) are arranged opposite one another concentrically about the recess 7 and such that they accommodate the foot 3 between them. In turn, the foot 3 is spring-loaded into its central position relative to the recess 7 by four helical springs 10 which act on the sides of the foot, each with a spacing of 90°.

Figure 4:
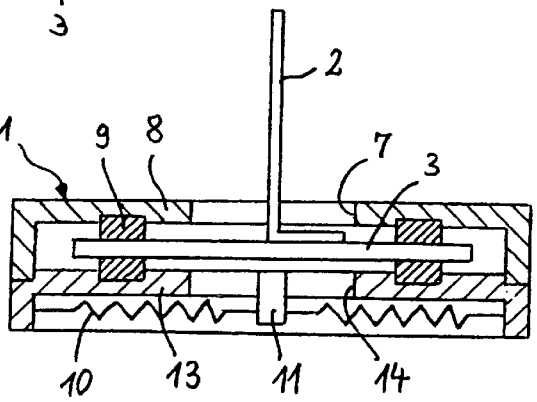
Figure 5:
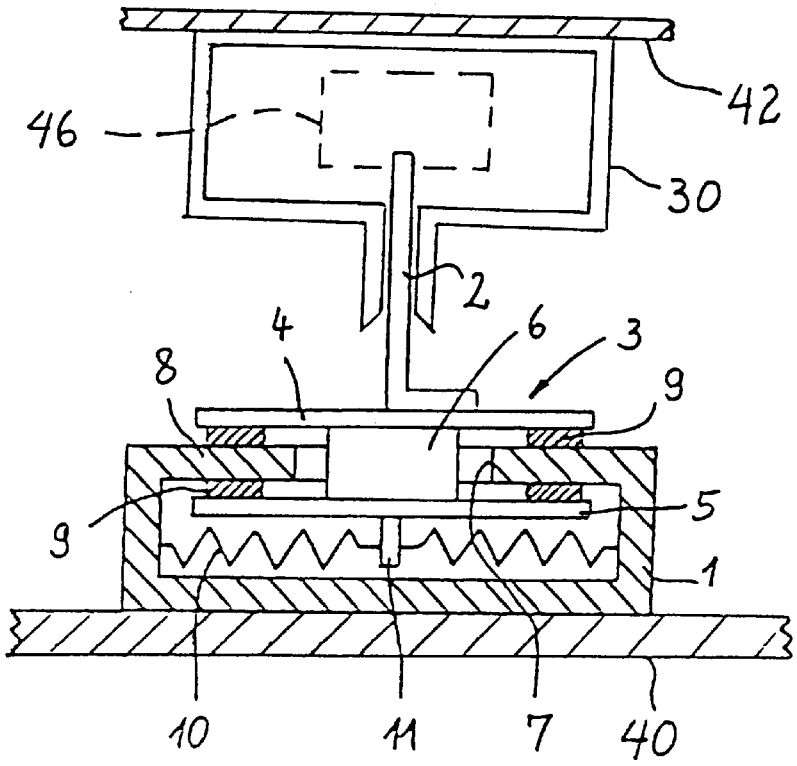
FIG. 5 depicts the actuator of FIG. 1 attached to a part, whose open and closed positions are to be monitored, operably disposed proximate a safety switch attached to a stationary part.

Yet another embodiment 20.2 of the present actuator is shown in FIG. 4. In this embodiment, the back wall 13 is likewise provided with a recess 14 through which the pin 11 (not present in the embodiment shown in FIG. 3) on the foot 3 projects, the helical springs 10 fastened to the back of the holder 1 again acting on the said pin 11 in order to spring-load the foot 3 centrally.

The spring load can also be applied by a rubber-elastic ring, particularly one accommodated inside the holder, the said ring interacting with the disc 5 located in the holder 1.

If necessary, the spring load can be disposed with. In this case, it is preferable for the foot 3 to be dimensioned such that the discs 4, 5 wedge to some extent on the holder 1 via the bearing.

Figure 2:
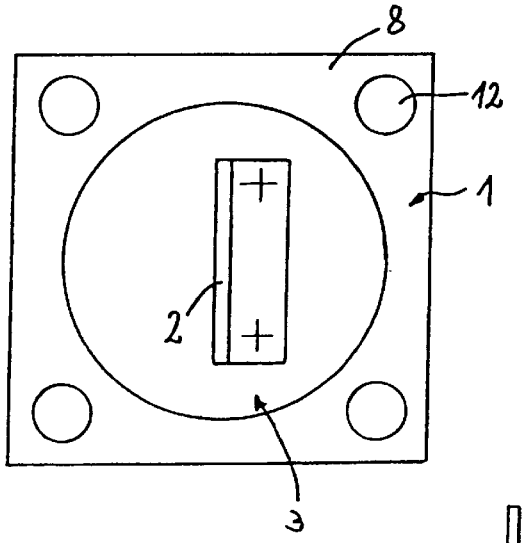
FIG. 2 shows a plan view of the actuator in FIG. 1.
Figure 6:
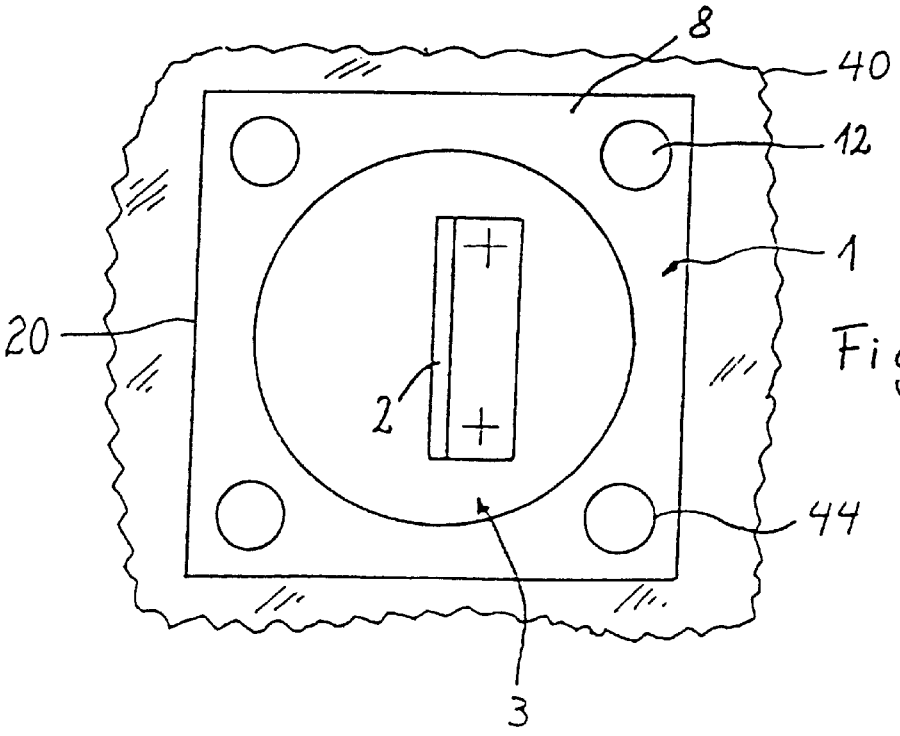
FIG. 6 is a plan view of the actuator of FIG. 1 attached to a part whose open and closed positions are to be monitored.

By way of example, the holder 1 is provided with holes 12 for screws 44 to pass through, for fastening to a part 40 whose open and closed positions are to be monitored, cf. FIGS. 2 and 6.

Although the invention has been described in some detail by way of illustration and example, for purposes of clarity and understanding, it will be obvious that certain changes and modifications may be practiced within the scope of the invention.

What is claimed is:

1. An actuator for a safety switch provided with at least one insertion slot with inclined insertion guides for the actuator, said actuator comprising:

a holder which can be fastened to a part whose open and closed positions are to be monitored, and a key held such that it can be moved by the holder and fitted with the holder, wherein the key comprises a foot, and the holder comprises a recess for the key and a first bearing, the recess for the key disposed on a holder side facing the key, the first bearing extending around the recess and allowing the foot to be displaced and rotated.

2. Actuator according the claim 1, wherein the foot comprises two parallel discs and the holder further comprises a front plate, said discs spaced apart from one another, said discs at least partially enclosing said front plate, said holder recess disposed between said discs, said discs mounted such that they can be displaced relative to said front plate.

3. Actuator according to claim 2, the foot further comprising a cylindrical intermediate piece connecting said discs.

4. Actuator according to claim 1, the holder further comprising a second bearing and two generally parallel walls, said holder walls spaced apart, said holder recess disposed in one of said holder walls, wherein the disc-shaped foot is mounted such that it can be displaced between said two parallel walls of the holder, one of said first and second bearings disposed on each of two mutually opposing surfaces of one of said walls.

5. Actuator according to claim 1, further comprising a second bearing, wherein said first and second bearings are sliding bearings and wherein the foot is mounted on the holder by means of said sliding bearings.

6. Actuator according to claim 1, further comprising a second bearing, wherein said first and second bearings are roller bearings and wherein the foot is mounted on the holder by means of said roller bearings.

7. Actuator according to claim 1, wherein the foot is spring-loaded in a central position relative to the recess.

8. Actuator according to claim 7, the holder further comprising at least three spring elements and wherein the foot is preloaded by said at least three spring elements.

9. Actuator according to claim 8, wherein the spring elements are arranged inside the holder.

* * * * *